US008404985B2

(12) United States Patent
Kim et al.

(10) Patent No.: US 8,404,985 B2
(45) Date of Patent: Mar. 26, 2013

(54) BUTTON ASSEMBLY FOR REFRIGERATOR

(75) Inventors: Do-Hyung Kim, Gyeongsangnam-Do (KR); Chang-Bong Choi, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 267 days.

(21) Appl. No.: 12/934,210

(22) PCT Filed: Dec. 22, 2008

(86) PCT No.: PCT/KR2008/007578

§ 371 (c)(1),
(2), (4) Date: Sep. 23, 2010

(87) PCT Pub. No.: WO2009/119967

PCT Pub. Date: Oct. 1, 2009

(65) Prior Publication Data

US 2011/0016901 A1 Jan. 27, 2011

(30) Foreign Application Priority Data

Mar. 24, 2008 (KR) ..... 10-2008-0027026

(51) Int. Cl.
*H01H 13/00* (2006.01)

(52) U.S. Cl. ..... 200/296; 200/341; 200/345

(58) Field of Classification Search ..... 200/520, 200/293–296, 302.1, 302.2, 310, 313, 314, 200/329–331, 341–345
See application file for complete search history.

(56) References Cited

U.S. PATENT DOCUMENTS

| | | | | |
|---|---|---|---|---|
| 5,803,238 | A * | 9/1998 | Roza | 200/332.1 |
| 6,499,894 | B1 * | 12/2002 | Yu et al. | 400/495 |
| 6,603,083 | B2 * | 8/2003 | Amari et al. | 200/5 D |
| 6,626,473 | B1 * | 9/2003 | Klein et al. | 292/347 |
| 6,882,280 | B2 * | 4/2005 | Ferragut, II | 340/587 |
| 7,230,196 | B2 * | 6/2007 | Toyama | 200/314 |
| 7,287,555 | B2 * | 10/2007 | Heger et al. | 141/86 |
| 2005/0072661 | A1 * | 4/2005 | Katagiri | 200/341 |
| 2007/0044497 | A1 * | 3/2007 | Roo et al. | 62/264 |
| 2007/0068029 | A1 | 3/2007 | Kwon et al. | |
| 2007/0151836 | A1 * | 7/2007 | Oh | 200/314 |
| 2007/0256036 | A1 * | 11/2007 | Johnson et al. | 715/866 |

FOREIGN PATENT DOCUMENTS

| | | | |
|---|---|---|---|
| JP | 2000-292050 | A | 10/2000 |
| JP | 2004-178822 | A | 6/2004 |
| KR | 10-0683832 | B1 | 2/2007 |

* cited by examiner

*Primary Examiner* — Michael Friedhofer
(74) *Attorney, Agent, or Firm* — Birch, Stewart, Kolasch & Birch, LLP

(57) ABSTRACT

A button assembly for a refrigerator comprises: a case having a cooling chamber, and a door for opening or closing the cooling chamber; a cover mounted to one side of the case, and provided with a plurality of button insertion openings; a substrate fixed to an inner side of the cover, and provided with a plurality of switch buttons; elastic supporters inserted into the button insertion openings of the cover, and covering the switch buttons of the substrate; and button pads coupled to the elastic supporters, and elastically supported by an elastic force of the elastic supporters when pressed by a user, for switching on/off the switch buttons. The button assembly prevents humid air from being introduced thereinto, and simplifies the components to enhance the reliability and productivity. The button assembly enhances appearance around the buttons.

12 Claims, 3 Drawing Sheets

BUTTON ASSEMBLY FOR REFRIGERATOR

TECHNICAL FIELD

The present invention relates to a button assembly for a refrigerator, and more particularly, to a button assembly for a refrigerator capable of preventing humid air from being introduced thereinto, simplifying an entire structure, and enhancing appearance around buttons.

BACKGROUND ART

Generally, a refrigerator serves to freshly store food items such as meat, fish, vegetable, and beverage. The refrigerator includes a refrigerator case provided with a freezing chamber, a refrigerating chamber, a vegetable chamber, etc., doors disposed at one side of the refrigerator case for opening and closing the freezing chamber and the refrigerating chamber.

The refrigerator case includes a refrigeration cycle apparatus composed of a compressor, a condenser, a capillary tube, an evaporator, etc., a blowing fan for forcibly flowing cool air formed by the evaporator, a circulation path for guiding cool air formed by the evaporator to be introduced into the evaporator via the freezing chamber and the refrigerating chamber, etc.

Once the freezing chamber or the refrigerating chamber has a temperature more than a preset temperature, the refrigeration cycle apparatus is operated, and thus the evaporator forms cool air. The cool air formed by the evaporator circulates the freezing chamber and the refrigerating chamber as the blowing fan is operated.

As the cool air circulates via the freezing chamber and the refrigerating chamber, preset temperatures of the freezing chamber, the refrigerating chamber, the vegetable chamber, etc. may be maintained.

The refrigerator may be classified into various types according to a cool air circulation method, positions of the freezing chamber and the refrigerating chamber, a configuration of the evaporator, etc.

The refrigerator is provided with various functions so as to meet a user's demands, and to enhance a user's convenience.

The refrigerator is equipped with an ice making system for making ice pieces. The ice making system includes an ice maker for making ice pieces, and an ice bank disposed below the ice maker for storing ice pieces made by the ice maker.

The ice pieces made by the ice maker are stored in the ice bank, and a user uses the ice pieces stored in the ice bank by drawing out the ice bank, or through a dispenser of the refrigerator.

The dispenser is provided at the door of the refrigerator. And, the dispenser includes a drawing space disposed at one side of a front surface of the door, a drawing opening disposed at an inner upper side of the drawing space for drawing out the ice pieces, drawing buttons disposed on a rear wall surface of the drawing space, and a supporting plate disposed at a bottom surface of the drawing space. A button assembly for setting a mode is provided at an upper side of the drawing space.

A desired mode of the dispenser is set as a user presses a button of the button assembly. When the user presses the button in a state that a vessel such as a cup is disposed below the button assembly, ice pieces are drawn out through the drawing opening.

However, the conventional dispenser has the following problems.

Since ice pieces are processed in the drawing space, humid air may be introduced between the buttons of the button assembly above the drawing space, and inner circumferential surfaces of the buttons. This may cause the button assembly to have corroded components, or to have a shortened lifespan.

DISCLOSURE OF INVENTION

Technical Problem

Therefore, it is one object of the present invention to provide a button assembly for a refrigerator capable of preventing humid air from being introduced thereinto, and simplifying an entire structure.

It is another object of the present invention to provide a button assembly for a refrigerator capable of enhancing appearance around buttons.

Technical Solution

To achieve these and other advantages and in accordance with the purpose of the present invention, as embodied and broadly described herein, there is provided a button assembly for a refrigerator, comprising: a case having a cooling chamber, and a door for opening or closing the cooling chamber; a cover mounted to one side of the case, and provided with a plurality of button insertion openings; a substrate fixed to an inner side of the cover, and provided with a plurality of switch buttons; elastic supporters inserted into the button insertion openings of the cover, and covering the switch buttons of the substrate; and button pads coupled to the elastic supporters, and elastically supported by an elastic force of the elastic supporters when pressed by a user, for switching on/off the switch buttons.

The cover is formed to be concaved from a front surface of the door, and is mounted to one side of the circumference of the drawing space for drawing out ice pieces stored in the cooling chamber.

The cover is mounted to one of both sides on the circumference of the drawing space.

The button insertion openings are disposed in a vertical direction.

The button insertion openings of the cover are formed in a square shape, and the elastic supporters inserted into the button insertion openings of the cover have square-shaped edges.

The elastic supporters include a body having a shape corresponding to the button insertion opening of the cover, and having a predetermined thickness; a connection portion formed in the body so as to have a predetermined thickness and length, for connecting one side of the body to another side of the body; a plurality of cylindrical portions extending from the connection portion in a cylindrical shape; and pressing portions extending from the connection portion by a predetermined length, for pressing the switch buttons of the substrate.

Each of the button pads includes a front surface portion formed to correspond to an upper surface of the body, and covering the upper surface of the body; an extension portion extending from the edge of the front surface by a predetermined thickness, and inserted between the connection portion and an inner wall of the body; and a locking protrusion curvedly extending from the end of the extension portion, and locked by the end of the elastic supporter to be fixed.

A first stepped portion is provided on an outer side surface of the elastic supporters, and a second stepped portion engaged with the first stepped portion is provided on an inner wall of the button insertion openings of the cover.

A locking hook is provided on an inner wall of the elastic supporter, and a locking protrusion locked by the locking hook to be fixed is provided at the end of the button pad.

The substrate includes light emitting devices (LEDs) for emitting light.

The elastic supporters are formed of a semi-transparent rubber material.

Advantageous Effects

The button assembly for a refrigerator according to the present invention has the following advantages.

The elastic supporters to which the button pads have been coupled are coupled to the button insertion openings of the cover, thereby serving as sealing members. This may prevent humid air from being introduced into a contact surface between inner circumferential surfaces of the button insertion openings and the elastic supporters, and between the elastic supporters and the button pads. This may enhance the reliability of the button assembly.

Also, the buttons coupled to the cover are composed of the elastic supporters and the button pads. This may reduce the number of components, thereby simplifying the entire structure and enhancing the productivity.

Furthermore, when the elastic supporter is coupled to the button insertion opening of the cover, the first stepped portion of the elastic supporter and the second stepped portion formed on an inner wall of the button insertion opening are adhered to each other. This may effectively prevent humid air from being introduced into the button assembly.

Furthermore, the button insertion openings of the cover are disposed in a vertical direction, and the buttons composed of the button pads and the elastic supporters are coupled to the button insertion openings. This may enable the drawing space of the dispenser to be long formed in a vertical direction, thereby allowing a vessel such as a cup to be disposed at the wide drawing space.

Furthermore, light emitting diodes (LEDs) are disposed on the substrate, and the elastic supporters are formed of a semi-transparent material. This may enable light emitted from the LEDs to serve as backlight. The emitted light provides sophisticated and mysterious feeling, and is more effective at night.

BEST MODE FOR CARRYING OUT THE INVENTION

Reference will now be made in detail to the preferred embodiments of the present invention, examples of which are illustrated in the accompanying drawings.

Hereinafter, a button assembly for a refrigerator according to the present invention will be explained in more detail with reference to the attached drawings.

A dispenser for a refrigerator may be provided at a refrigerator body, or at a refrigerator door. Hereinafter, will be explained a case that the dispenser is provided at the refrigerator door.

Figure 1:
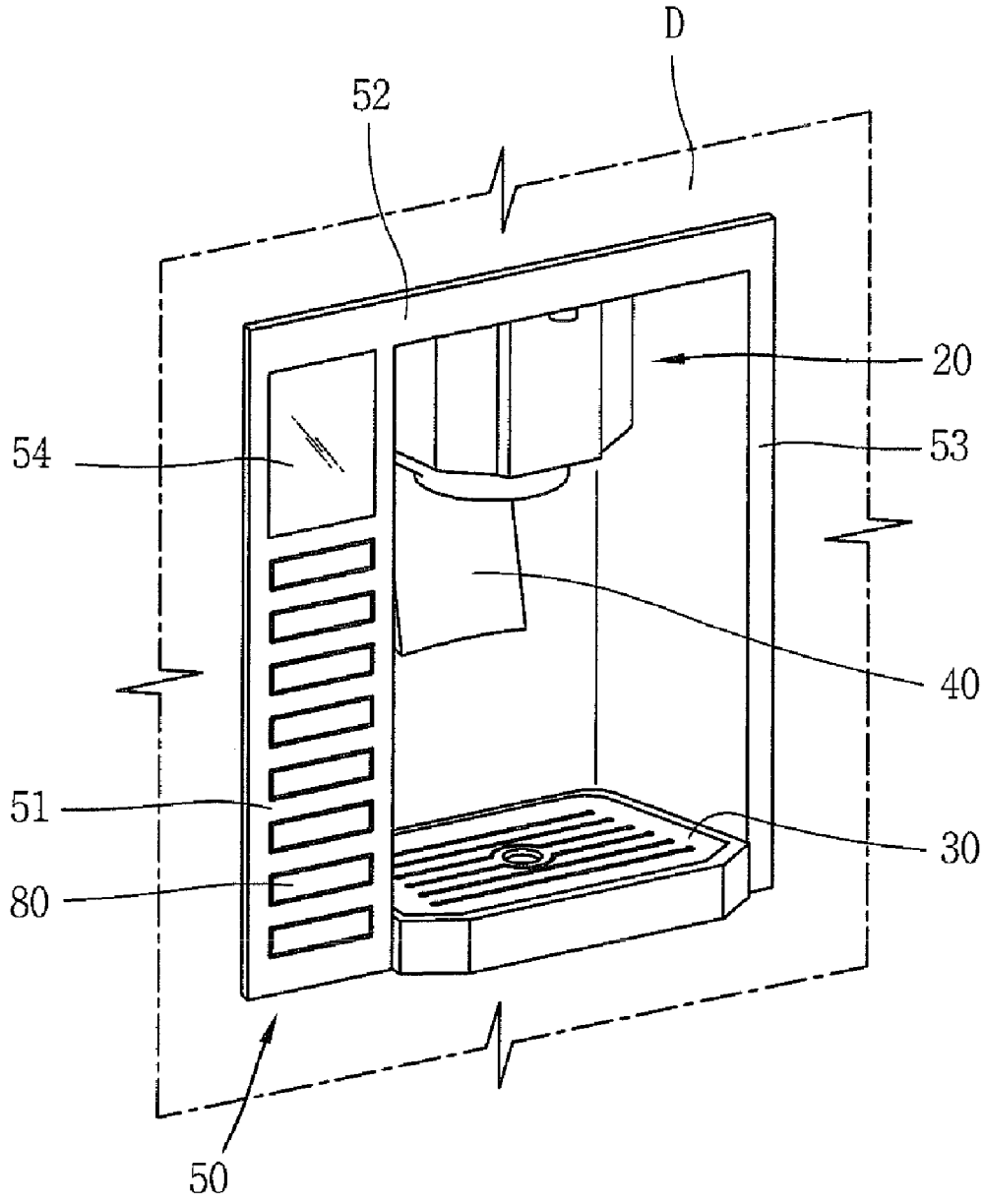
FIG. 1 is a perspective view showing a button assembly of a dispenser for a refrigerator according to a first embodiment of the present invention.
Figure 2:
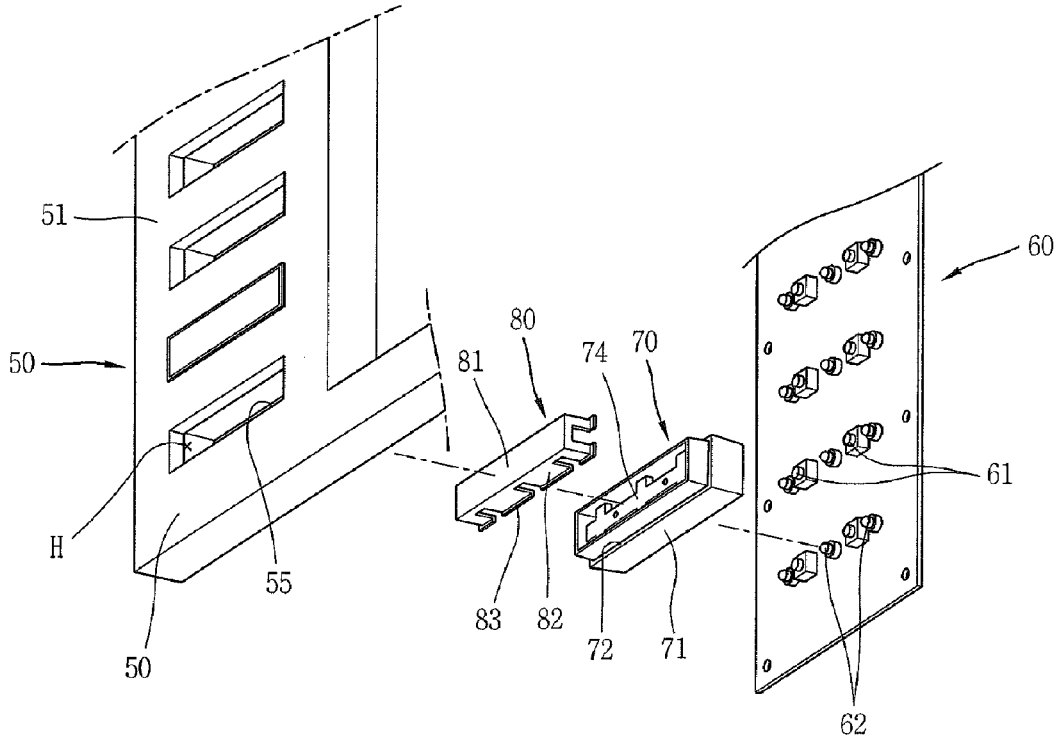
FIG. 2 is an exploded perspective view showing the button assembly for a refrigerator according to a first embodiment of the present invention.

FIG. 1 is a perspective view showing a button assembly of a dispenser for a refrigerator according to a first embodiment of the present invention, and FIG. 2 is an exploded perspective view showing the button assembly for a refrigerator according to a first embodiment of the present invention.

As shown, the dispenser includes a case 10 having a drawing space therein and mounted to one side of the refrigerator door (D), a drawing opening 20 disposed at an inner upper portion of the case 10, a supporting plate 30 coupled to a lower surface of the case 10, and a drawing button 40 disposed on a rear surface of the case 10. The drawing opening 20 may be protrudingly formed.

A cover 50 provided with a plurality of button insertion openings (H) is coupled to the case 10 of the dispenser.

The cover 50 includes a panel portion 51 having a predetermined area, and provided with the plurality of button insertion openings (H) disposed in a vertical direction; a front horizontal cover portion 52 extending from one upper side of the panel portion 51 by a predetermined length; and a front vertical cover portion 53 extending from one end of the front horizontal cover portion 52 by a predetermined length. A display unit 54 is provided at one side of the panel portion 51.

The button insertion openings (H) are vertically disposed in one row.

The button insertion openings (H) are formed in a square shape. However, the button insertion openings (H) may be formed to have various forms.

The cover 50 may cover the edge of the case 10.

A substrate 60 is fixedly coupled to an inner side of the cover 50. Preferably, the substrate 60 is fixedly coupled to the cover 50 so as to be located in the panel portion of the cover 50. A part where the substrate 60 is located is sealed by one side wall of the case 10, and one side wall of the cover 50.

A plurality of switch buttons 61 are provided on the substrate 60 in a plurality of lines. The respective lines are disposed to correspond to the button insertion holes (H) of the cover 50. Preferably, two switch buttons 61 are disposed in each of the lines of the switch buttons 61. And, light emitting devices 62 are disposed between the switch buttons 61.

The switch buttons 61 and the light emitting devices 62 are coupled to each other to be protruding from one surface of the substrate 60.

The elastic supporters 70 are coupled to the button insertion holes (H) of the cover 50, thereby covering the switch buttons 61 and the light emitting devices 62 of the substrate 60.

The button pads 80 are coupled to the elastic supporters 70 so as to be disposed in the button insertion holes (H) of the cover 50.

The elastic supporters 70 are coupled to the button insertion holes (H) of the cover 50 in an adhered manner, and are coupled to the button pads 80 in a compressed manner. The elastic supporters 70 serve to seal between the button pads and the button insertion holes (H) of the cover 50, and to seal between the elastic supporters 70 and the button pads 80.

The elastic supporters 70 are formed of a rubber material to come in contact with the substrate 60 by its elasticity.

Preferably, the elastic supporters 70 inserted into the button insertion holes (H) of the cover 50 are formed to have a square-shaped edge in correspondence to the shape of the button insertion holes (H).

A first stepped portion 72 is provided on an outer side surface of the elastic supporters 70, and a second stepped portion 55 engaged with the first stepped portion 72 is provided on an inner wall of the button insertion openings (H) of the cover 50. Accordingly, the elastic supporters 70 are fixedly coupled to the button insertion holes (H) of the cover 50.

Preferably, a locking hook 73 is provided on an inner wall of the elastic supporters 70, and a locking protrusion 83 locked by the locking hook 73 to be fixed is provided at the end of the button pad 80. Accordingly, the button pad 80 is fixedly coupled to the elastic supporter 70.

Figure 3:
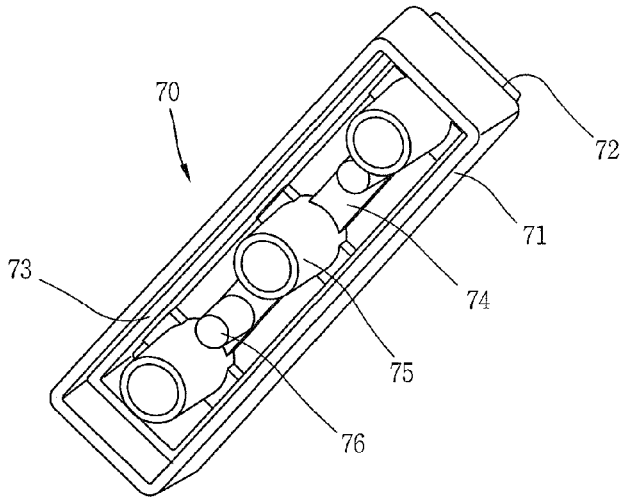
FIG. 3 is a perspective view showing elastic supporters of the button assembly for a refrigerator according to a first embodiment of the present invention.

Referring to FIGS. 2 and 3, each of the elastic supporters 70 include a body 71 having a shape corresponding to a sectional shape of the button insertion opening (H) of the cover 50, and having a predetermined thickness; a first stepped portion 72 formed at an upper portion on an outer wall of the body 71; a locking hook 73 formed at a lower portion on an inner wall of the body 71; a connection portion 74 formed in the body 71 so as to have a predetermined thickness and length, for connecting one side of the body 71 to another side of the body 71; a plurality of cylindrical portions 75 extending from the connection portion 74 in a cylindrical shape; and pressing portions 76 extending from the connection portion 74 by a predetermined length, for pressing the switch buttons 61 of the substrate 60.

The body 71 is formed in a square shape, and a lower portion of the body 71 has a smaller area than an upper portion of the body 71 due to the first stepped portion 72 and the locking hook 73.

The cylindrical portions 75 are disposed to cover the light emitting devices 61 on the substrate 60. And, the pressing portions 76 are arranged so as to be disposed on the same positions as the switch buttons 61 on the substrate 60.

One end of the body 71 of the elastic supporters 70 is disposed on the same position as one end of the cylindrical portions 75 so as to come in contact with one surface of the substrate 60, respectively.

Preferably, the elastic supporters 70 are formed of a semi-transparent rubber so that light emitted from the light emitting devices 61 can be reflected to outside.

Figure 4:
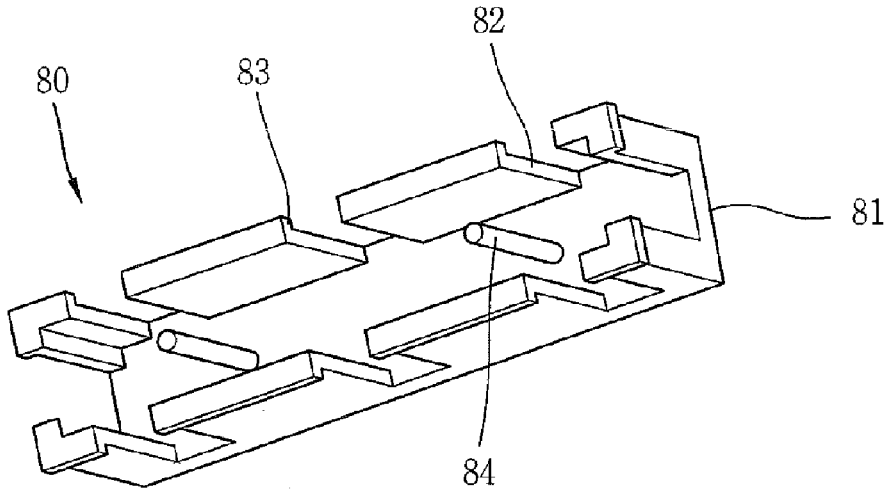
FIG. 4 is a rear view showing button pads of the button assembly for a refrigerator according to a first embodiment of the present invention.

Referring to FIGS. 2 and 4, each of the button pads 80 may include a front surface portion 81 formed in a shape corresponding to an upper section of the body 71, and covering an upper surface of the body 71; an extension portion 82 extending from the edge of the front surface portion 81 by a predetermined thickness, and inserted between the connection portion 74 and an inner wall of the body 71; a locking protrusion 83 curvedly extending from the end of the extension portion 82, and locked by the locking hook 73 to be fixed; and a pressing pin 84 extending from a rear surface of the front surface portion 81 by a predetermined length, and inserted into the pressing portion 76.

Figure 5:
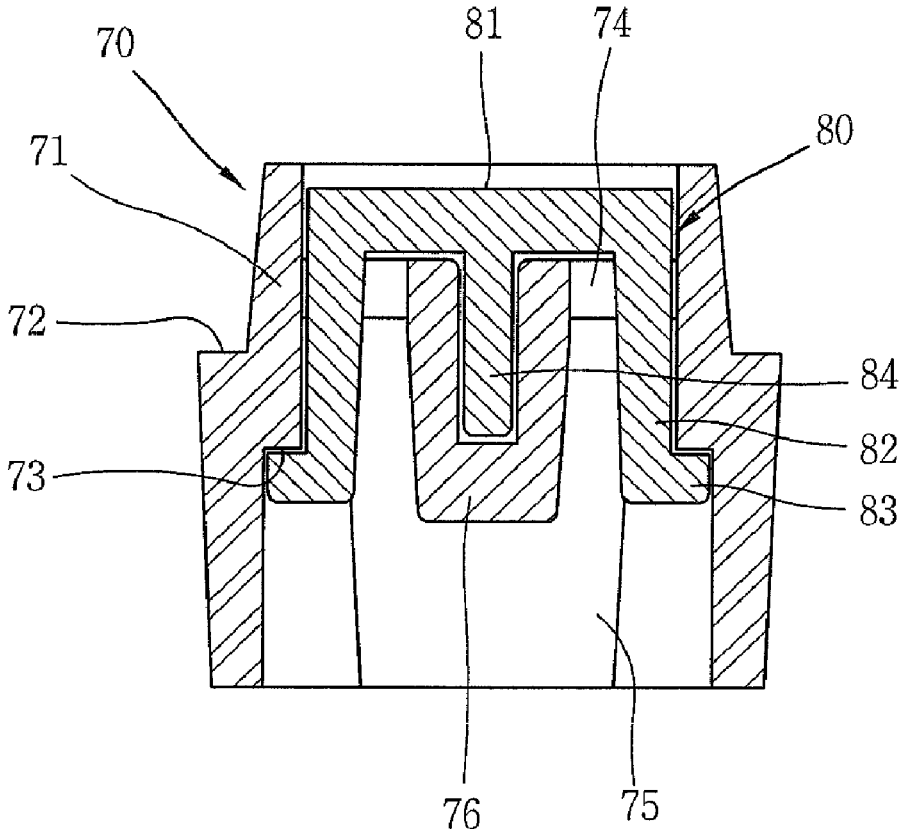
FIG. 5 is a sectional view showing a coupled state between the elastic supporters and the button pads of the button assembly for a refrigerator according to a first embodiment of the present invention.

As shown in FIG. 5, as the extension portion 82 of the button pad 80 is inserted into a hole formed between the connection portion 74 of the elastic supporter 70 and the inner wall of the body 71, the locking protrusion 83 formed at the end of the extension portion 82 is locked by the locking hook 73 to be fixed. Here, the front surface portion 81 is disposed at an upper portion inside the body 71 of the elastic supporters 70, thereby covering the upper portion of the body 71. The front surface portion 81 is not downwardly moved due to the connection portion 74 of the elastic supporters 70. And, the pressing pins 84 of the button pads 80 are inserted into the pressing portions 76 of the elastic supporters 70, respectively.

The elastic supporters 70 to which the button pads 80 has been coupled are coupled to the button insertion openings (H) of the cover 50 so that an upper portion thereof can be protruding toward an outer surface of the panel portion 51 of the cover 50. The front surface portion 81 of the button pad 80 is exposed out.

In a state that the button pads 80 are inserted into the button insertion openings (H) of the cover 50, the substrate 60 is fixedly coupled to inside of the cover 50. Here, each body 71 of the elastic supporters 70 comes in contact with the substrate 60 with covering the switch buttons 61 of the substrate 60. And, the cylindrical portions 75 cover the light emitting devices 61, respectively.

The elastic supporters 70 to which the button pads 80 have been coupled serve to press the switch buttons 61 of the substrate 60.

Hereinafter, the operation of the button assembly for a refrigerator according to a first embodiment of the present invention will be explained.

Firstly, a user selects a desired mode for drawing out ice pieces through the drawing opening 20, and presses the button pads 80 disposed on the panel portion 51 of the cover 50. Then, a vessel such as a cup is disposed below the drawing opening 20, and then the drawing button 40 is pressed. As a result, ice pieces or water mixed with ice pieces are drawn out through the drawing opening 20.

Once the button pads 80 are pressed, the button pads 80 are pushed together with the elastic supporters 70. Accordingly, the pressing portions 76 of the button pads 80 press the switch buttons 61 of the substrate 60. Then, when the pressing force applied onto the button pads 80 is released, the elastic supporters 70 are restored to the original state by their elastic forces, and the button pads 80 are restored to the original positions.

The button assembly for a refrigerator according to the present invention has the following advantages.

The button pads 80 are coupled to the elastic supporters 70 formed of a rubber material, and the elastic supporters 70 to which the button pads 80 have been coupled are coupled to the button insertion openings (H) of the cover 50. The elastic supporters 70 serving as sealing members prevent humid air from being introduced into a contact surface between inner circumferential surfaces of the button insertion openings (H) and the elastic supporters, and between the elastic supporters 70 and the button pads 80. This may enhance the reliability of the button assembly.

Also, the buttons coupled to the cover 50 are composed of the elastic supporters 70 and the button pads 80. This may reduce the number of components, thereby simplifying the entire structure and enhancing the productivity Furthermore, in a state that the extension portion 82 of the button pad 80 is inserted into the elastic supporter 70, the locking protrusion 83 is locked by the locking hook 73 to be fixed. This may allow the elastic supporter 70 and the button pad 80 to be stably coupled to each other.

Furthermore, the first stepped portion 72 of the elastic supporters 70 is adhered to the second stepped portion 55 formed on an inner wall of the button insertion openings (H) when the elastic supporters 70 are coupled to the button insertion openings (H) of the cover 50. This may effectively prevent humid air from being introduced into the button assembly.

Furthermore, the button insertion openings (H) of the cover 50 are disposed in a vertical direction, and the buttons composed of the button pads 80 and the elastic supporters 70 are coupled to the button insertion openings (H). This may enable the drawing space of the dispenser to be long formed in a vertical direction, thereby allowing a vessel such as a cup to be disposed at the wide drawing space. If the buttons are horizontally disposed above the drawing space, it may be disadvantageous to form the drawing space in a vertical direction. This may cause a user's inconvenience in using a long vessel such as a cup.

Furthermore, light emitting devices 61 are disposed on the substrate 60, and the elastic supporters 70 are formed of a semi-transparent material. This may enable light emitted from the light emitting devices 61 to serve as backlight. The emitted light provides sophisticated and mysterious feeling, and is more effective at night.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A button assembly for a refrigerator, comprising:

a case having a cooling chamber, and a door for opening or closing the cooling chamber;

a cover mounted to one side of the case, and provided with a plurality of button insertion openings;

a substrate fixed to an inner side of the cover, and provided with a plurality of switch buttons;

elastic supporters inserted into the button insertion openings of the cover, and covering the switch buttons of the substrate; and button pads coupled to the elastic supporters, and elastically supported by an elastic force of the elastic supporters when pressed by a user, for switching on/off the switch buttons, wherein each of the elastic supporters comprises:

a body having a shape corresponding to the button insertion opening of the cover, and having a predetermined thickness;

a connection portion formed in the body so as to have a predetermined thickness and length, for connecting one side of the body to another side of the body;

a plurality of cylindrical portions extending from the connection portion in a cylindrical shape; and pressing portions extending from the connection portion by a predetermined length, for pressing the switch buttons of the substrate, wherein each of the button pads comprises:

a front surface formed to correspond to an upper surface of the body, and covering the upper surface of the body;

an extension portion extending from the edge of the front surface by a predetermined thickness, and inserted between the connection portion and an inner wall of the body; and a locking protrusion curvedly extending from the end of the extension portion, and locked by the end of the elastic supporter to be fixed.

2. The button assembly for a refrigerator of claim 1, wherein the cover is formed to be concaved from a front surface of the door, and is mounted to one side of a circumference of the drawing space for drawing out ice pieces stored in the cooling chamber.

3. The button assembly for a refrigerator of claim 2, wherein the cover is mounted to an upper portion of the circumference of the drawing space.

4. The button assembly for a refrigerator of claim 2, wherein the cover is mounted to one of both sides on the circumference of the drawing space.

5. The button assembly for a refrigerator of claim 2, wherein the button insertion openings of the cover are disposed in a vertical direction.

6. The button assembly for a refrigerator of claim 2, wherein the button insertion openings of the cover are formed in a square shape, and the elastic supporters inserted into the button insertion openings have square-shaped edges.

7. The button assembly for a refrigerator of claim 1, wherein the elastic supporters further comprise a locking hook for fixing the locking protrusion below an inner wall of the body.

8. The button assembly for a refrigerator of claim 1, wherein the elastic supporter further comprises a first stepped portion formed at an upper portion of an outer wall of the body, for limiting a motion of the body in a thickness direction of the cover by being locked by an inner wall surface of the circumference of the button insertion opening.

9. The button assembly for a refrigerator of claim 8, wherein a second stepped portion engaged with the first stepped portion is further provided on an inner wall surface of the circumference of the button insertion opening of the cover.

10. The button assembly for a refrigerator of claim 1, wherein one end of the body of the elastic supporters, and one end of the cylindrical portions come in contact with one surface of the substrate, respectively.

11. The button assembly for a refrigerator of claim 1, wherein the substrate comprises light emitting devices for emitting light.

12. The button assembly for a refrigerator of claim 1, wherein the elastic supporters are formed of a semi-transparent rubber material.

* * * * *